US005370228A

United States Patent [19]

Manke

[11] Patent Number: 5,370,228

[45] Date of Patent: Dec. 6, 1994

[54] RECEIVING DEVICE FOR STACKABLE CONTAINERS

[76] Inventor: Wolfgang Manke, Apfelweg 15, D-4830 Gütersloh 1, Germany

[21] Appl. No.: 888,179

[22] Filed: Jul. 7, 1992

Related U.S. Application Data

[63] Continuation of PCT/DE91/00867, filed Nov. 4, 1991.

[30] Foreign Application Priority Data

| | | | |
|---|---|---|---|
| Nov. 7, 1990 | [DE] | Germany | 4035393 |
| Nov. 19, 1990 | [DE] | Germany | 4036874 |
| Jan. 28, 1991 | [DE] | Germany | 4102470 |

[51] Int. Cl.[5] ..... B65D 21/00

[52] U.S. Cl. ..... 206/499; 206/430; 220/909; 211/59.4

[58] Field of Search ..... 206/499, 427, 430, 443, 206/445, 446; 220/507, 909, 532; 211/59.4, 71

[56] References Cited

U.S. PATENT DOCUMENTS

| | | | |
|---|---|---|---|
| 1,497,528 | 6/1924 | Meyers | 206/499 X |
| 2,614,687 | 10/1952 | Roy | 206/499 X |
| 2,771,216 | 11/1956 | Reiner | 206/499 X |
| 3,014,581 | 12/1961 | Storck | 206/499 X |
| 3,146,112 | 8/1964 | Weinstein | 206/499 X |
| 3,306,439 | 2/1967 | Storey | 206/499 X |
| 3,411,665 | 11/1968 | Blum | 206/499 X |
| 4,619,366 | 10/1986 | Kreeger | 206/507 |
| 4,789,062 | 12/1988 | Walsh | 206/427 |
| 4,901,857 | 2/1990 | Emerick | 206/427 |
| 5,020,175 | 6/1991 | Kirkpatrick et al. | 206/430 X |
| 5,115,914 | 5/1992 | Dario | 206/499 |

FOREIGN PATENT DOCUMENTS

| | | | |
|---|---|---|---|
| 2315457 | 1/1977 | France | 211/59.4 |
| 7520996 | 1/1977 | France . | |
| 686657 | 3/1965 | Italy | 206/499 |
| 1535922 | 12/1978 | United Kingdom . | |
| 2017645 | 10/1979 | United Kingdom | 220/507 |

*Primary Examiner*—Allan N. Shoap
*Assistant Examiner*—Stephen Cronin
*Attorney, Agent, or Firm*—Herbert L. Lerner; Laurence A. Greenberg

[57] ABSTRACT

A receiving device for stackable containers is provided. The device comprises an upper end plate having openings formed therein with a diameter which is at least slightly larger than the largest diameter of the stackable containers. A plurality of substantially parallel receiver tubes are connected to the upper end plate and communicate with the openings in the upper end plate. The receiver tubes are formed of flexible material, they may be defined by a honeycomb insert, or they may be formed of strip sections. The receiver tubes and the upper end plate form an insert unit for insertion into a garbage container.

13 Claims, 7 Drawing Sheets

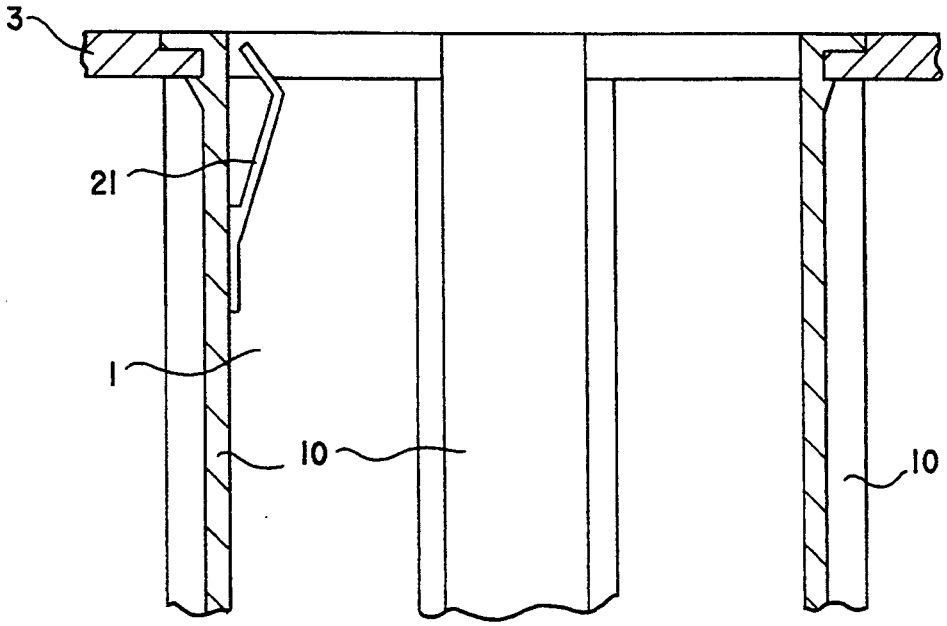
Fig.8
Fig.9
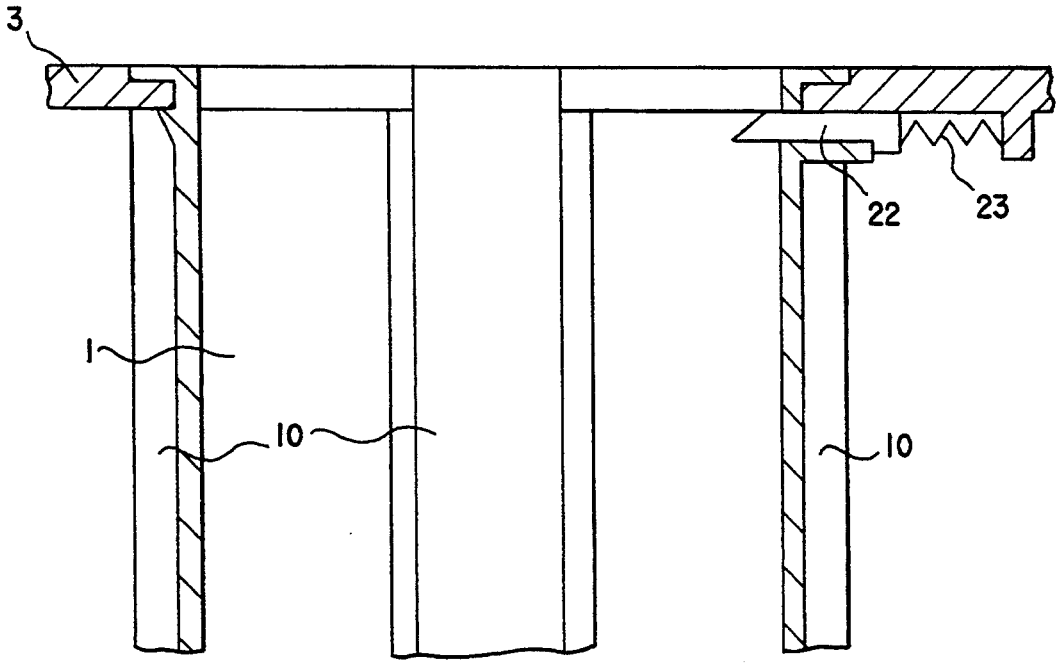

RECEIVING DEVICE FOR STACKABLE CONTAINERS

CROSS-REFERENCE TO RELATED APPLICATION

This application is a continuing application of international application PCT/DE91/00867, filed Nov. 4, 1991, and designating the United States.

BACKGROUND OF THE INVENTION

Field of the Invention

The invention relates to a receiving device for stackable containers, in particular for drinking cups of plastic, consisting of parallel receiver tubes which communicate with the openings of an end plate and whose cross sectional area is slightly larger than the largest cross sectional area of the stackable containers and which are connected to a unit which is insertable into a garbage container.

Used drinking cups of plastic are usually thrown into a garbage container, such as a garbage can or a garbage bag, which is clamped to a garbage bag stand. The cups thus thrown occupy a large storage volume, which adversely affects collection and transport. Also, fluids which remain in the cups are left to ooze out of the cups.

A collection device for stackable plastic cups is already known from German petty patent G 90 00 735.2. The collection device with at least one opening must be attached to a stationary carrier, preferably to a wall. It is thereby important that the opening width in the collection device is smaller than the diameter of the cup at its upper rim and larger than the bottom of the cup. Accordingly, the cups to be disposed of are stacked in the collection device and the stacks are then manually removed from the collection device once they reach a corresponding height.

That collection device is respectively provided for only a certain shape and size of a cup. Also, stackability is relatively limited, so that a manual removal of the stacked, dirty cups is often necessary.

Furthermore, GB-PS 15 35 922 describes a device for receiving used plastic or paper cups, wherein tubes for stackingly receiving cups which extend into the container are connected to openings provided in a container lid. A similar device is also known from FR-PS 23 15 457 where the receiver tubes can be replaced with vertically oriented rods.

Disadvantageous in these known devices are the unstable mounting of the receiver tubes at the container lid and the substantial amount of material required due to the usage of tubes. The configuration of the receiver chutes with vertical rods does not allow for the exact guidance of the falling cups and, particularly, a stable disposition of the receiver chutes is not possible.

It is accordingly an object of the invention to provide a receiving device for stackable containers, particularly for plastic drinking cups, which overcomes the hereinaforementioned disadvantages of the heretofore-known devices of this general type and which can hold a plurality of receiver tubes and which saves material and is light. A further object is to provide a stable, compact unit which assures good guidance in the receiver tubes for the stackable containers.

SUMMARY OF THE INVENTION

With the foregoing and other objects in view there is provided, in accordance with the invention, a receiving device for stackable containers having a cross-sectional area with a largest diameter, comprising an upper end plate having openings formed therein with a diameter being at least slightly larger than the largest diameter of the stackable containers, a plurality of substantially parallel receiver tubes connected to the end plate and respectively communicating with the openings in the upper end plate, the receiver tubes and the upper end plate forming an insert unit for insertion into a garbage container.

In accordance with an added feature of the invention, the receiver tubes are formed of a flexible material or they are defined by a honeycomb insert.

In accordance with an additional feature of the invention, the device includes an intermediate plate having openings formed therein and a lower end plate; the receiver tubes are formed of longitudinally extending strips having an arc-shaped cross section; the strips are insertable into the openings of the intermediate plate and are attachable to the upper and lower end plates.

In accordance with another feature of the invention, the device includes undercut cutouts formed in the intermediate plate for fastening the strips thereto.

In accordance with a further feature of the invention, the longitudinal strips are each formed of two strip sections, each of the sections including latch connector means for interconnecting the sections to a contiguous unit.

In accordance with again another feature of the invention, each of the longitudinal strips has a nose formed thereon at an upper end face, the nose projecting substantially perpendicularly away from the longitudinal strip, and the upper end plate has an auxiliary recess formed therein directly adjacent the opening for receiving the nose of the longitudinal strip such that the end face with the nose is disposed flush with an upper surface of the upper end plate.

In accordance with again an added feature of the invention, the intermediate plate has additional recesses formed therein directly adjacent the undercut cutouts, and the longitudinal strips include two oppositely conical latches for clamping therebetween the additional recesses.

In accordance with again a further feature of the invention, each of the longitudinal strips has two longitudinal ribs formed thereon which are guided in corresponding notches in the cutouts of the end and intermediate plates.

In other words, the receiver tubes are formed of a flexible material or of a honeycomb-shaped insert or of several longitudinally oriented, arc-like strips which are insertable in the openings of the intermediate plate provided with undercut recesses and in a respective upper and lower end plate.

According to a preferred embodiment of the invention, the longitudinal strips are divided and the two parts are connected to a contiguous unit by means of an overlapping latch connection. In an embodiment of the invention, one respective end face of the divided longitudinal strips is provided with a projection, which lies in a rectangular additional recess of the undercut recess of the upper end plate or the lower end plate, whereby the outer border of the projection lies in a plane with the respectively outer surface of the upper or of the lower end plate. Each intermediate plate suitably is provided with an additional recess adjacent the undercut recesses, the additional recesses which are associated with two respective conical, mutually oppositely oriented latches of the longitudinal strips. The inside of the longitudinal strips may be provided with two longitudinal strips for increasing the stability.

In accordance with yet another feature of the invention, the receiving device is provided with means for reducing the diameter of the openings in the vicinity of the upper end plate and, in accordance with the invention, the reducing means are in the form of an elastic element or of a slide element disposed in the receiver tube in the vicinity of the upper end plate.

In accordance with the invention, the elastic element is a leaf spring and the slidable element is disposed in the receiver tube in the vicinity of said upper end plate and being slidable between a diameter-reducing position and a retracted position.

In accordance with yet a further feature of the invention, the device includes downwardly bent knees formed on a circumference of the openings in the upper end plate for facilitating the entry of the used drinking cups into the chute, and for better attaching the receiver tubes the end plate.

In accordance with still a further feature of the invention, the honeycomb insert is formed of a plurality of elements and/or it may be folded to a flat structure for better transport and storage.

In other words, each receiver tube has an elastic or slidable element in the vicinity of the upper end plate for reducing the diameter of the chute entrance, whereby the elastic element is a leaf spring and the slidable element is formed of a slide which can be pushed out into the clear opening of the receiver tube. It is possible that the edges of the insertion openings in the end plate are each circumferentially angled downwardly and that the receiver tubes are connectible to these knees. The honeycomb-shaped insert is preferably formed of individual elements to be assembled or of a one-piece plastic element, whereby openings in any desired shape contribute to lighter weight and to associated material savings. The honeycomb-shaped insert can be foldable into a plane.

The receiving device for stackable containers embodied according to the invention is inserted in a garbage container, which may be a garbage can or a garbage bag clamped to a garbage bag stand, and fixed at the upper edge of the garbage container with the end plate. The used, stackable cups are inserted in the individual receiver tubes and the cups slide downwardly due to their weight. When all of the receiver tubes are filled in their entire lengths with used drinking cups, the end plate with the receiver tubes attached thereto is lifted out of the garbage container, whereby the stacked, used drinking cups remain in the garbage container.

Other features which are considered as characteristic for the invention are set forth in the appended claims.

Although the invention is illustrated and described herein as embodied in a receiving device for stackable containers, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 8 is a view similar to FIG. 3, but with a leaf spring disposed in the receiver tube;

FIG. 9 is a view, similar to that of FIG. 8, of a further embodiment of the invention;

DESCRIPTION OF THE PREFERRED EMBODIMENTS

Figure 1:
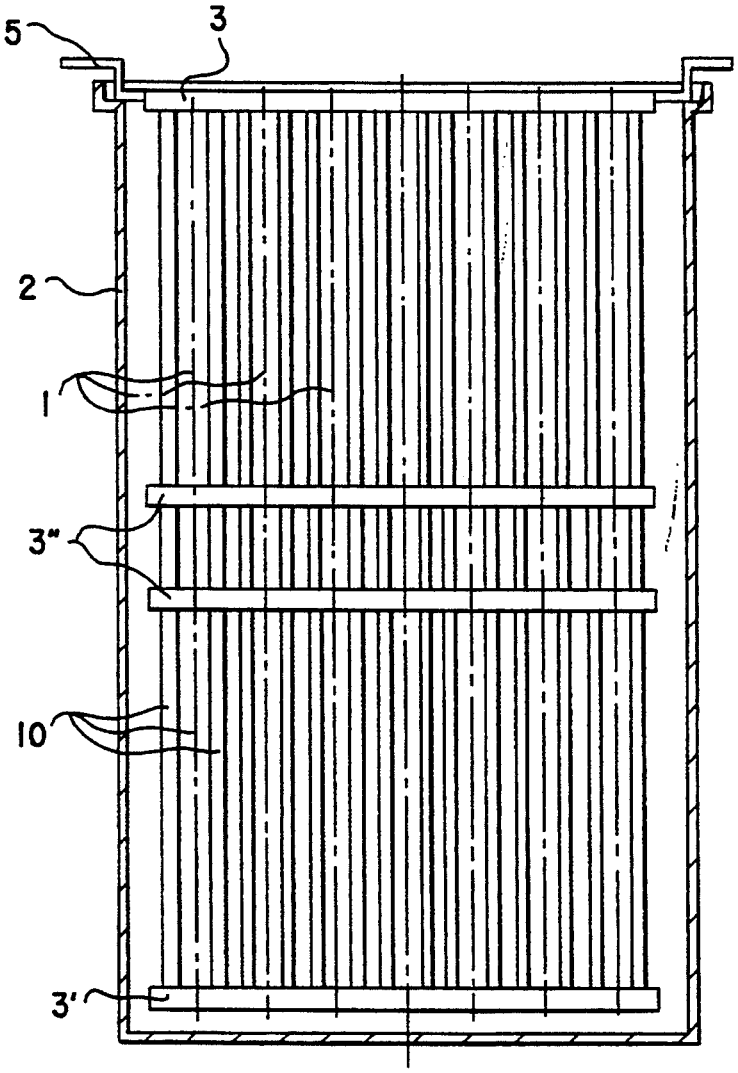
FIG. 1 is a side-elevational view of a vertical cross-section through a garbage can with an receiving device according to the invention inserted therein.

Referring now to the figures of the drawings in detail and first, particularly, to FIG. 1 thereof, the receiving device for stackable drinking cups inserted in a garbage can 2 comprises parallel receiver tubes 1, the diameter of which is slightly larger than the maximum diameter of the drinking cup. Each receiver tube 1 is respectively rigidly mounted in an upper end plate 3, a lower end plate 3' and intermediate plates 3''. All of the receiver tubes 1 of a receiving device combine to a unit by way of the plates 3; 3'; 3''.

Figure 2:
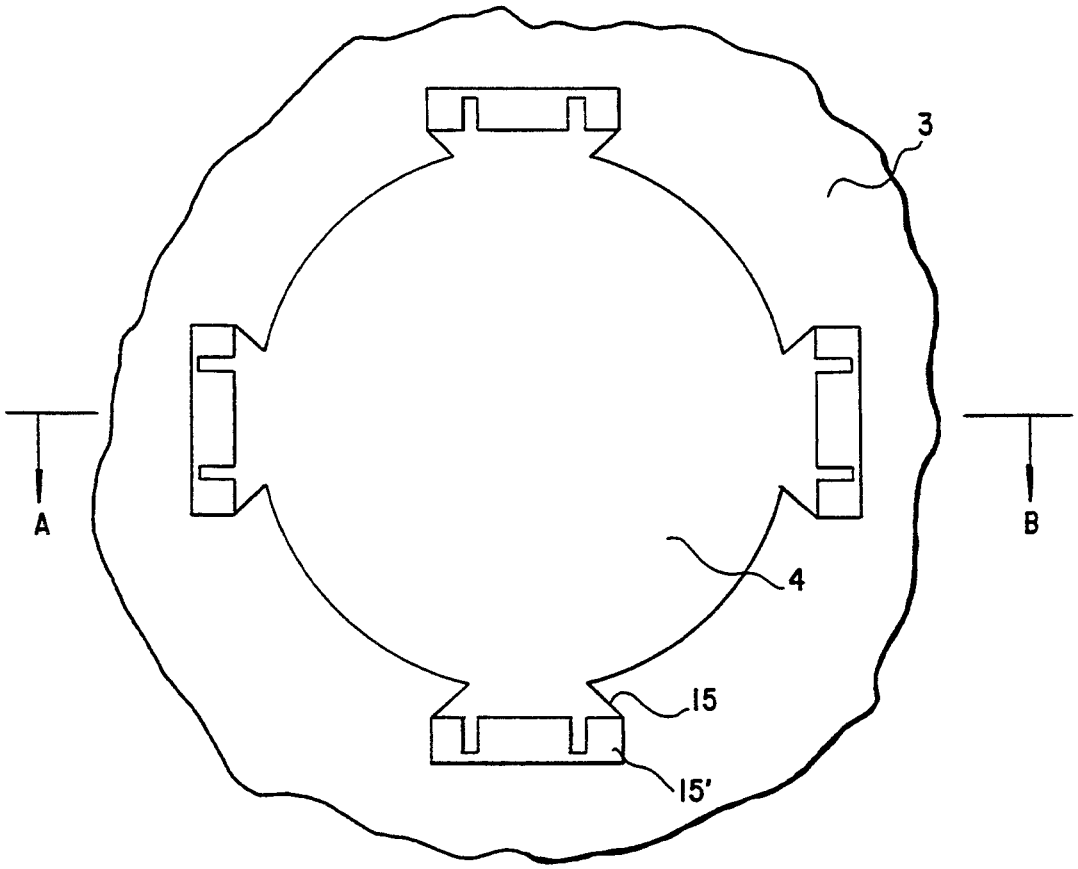
FIG. 2 is a top-plan, partial view of the end plate with an opening for receiving a receiver tube.
Figure 3:
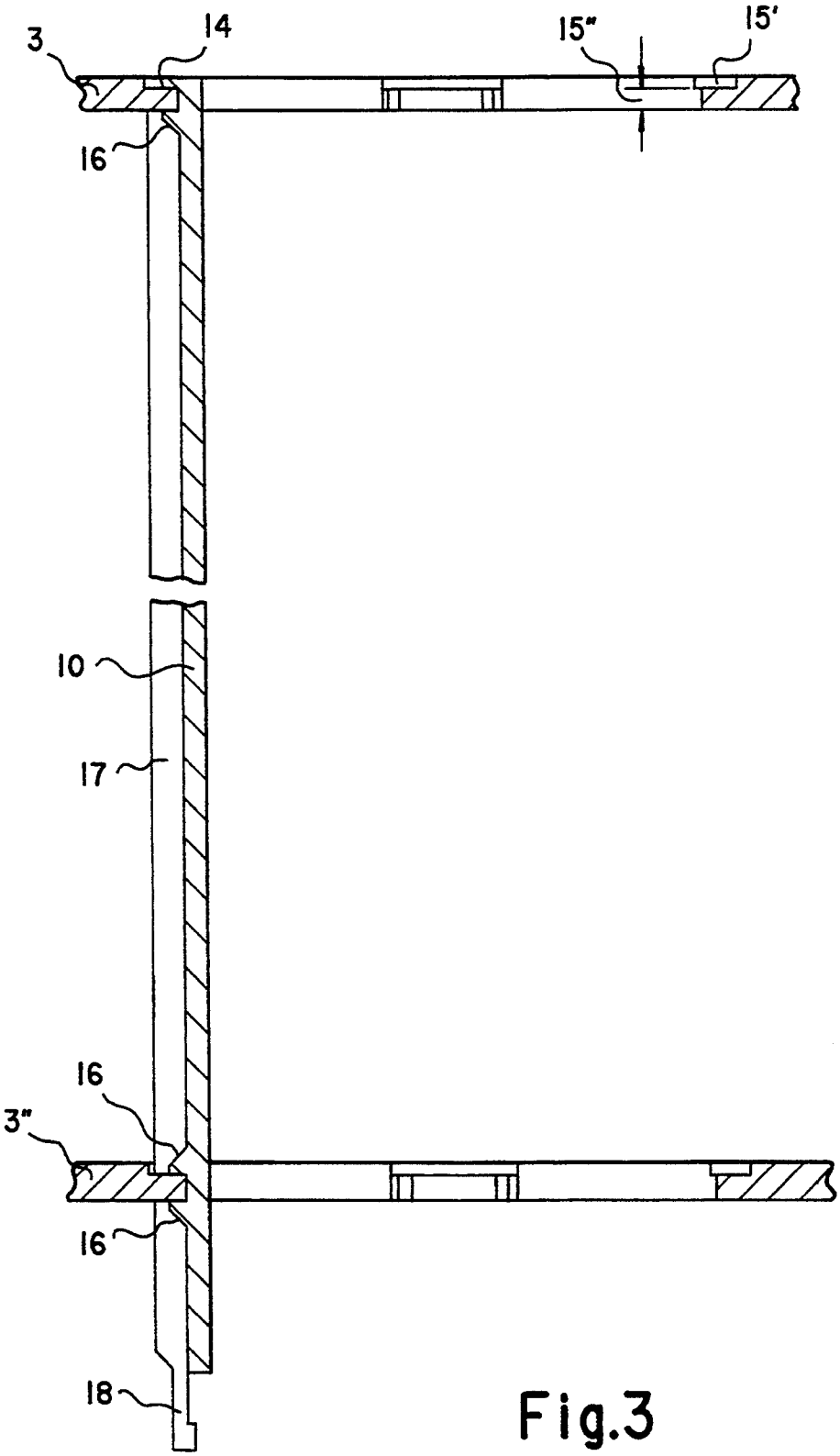
FIG. 3 is a cross-sectional view taken along the line A-B of FIG. 2 with one longitudinal strip according to the invention inserted therein.
Figure 4:
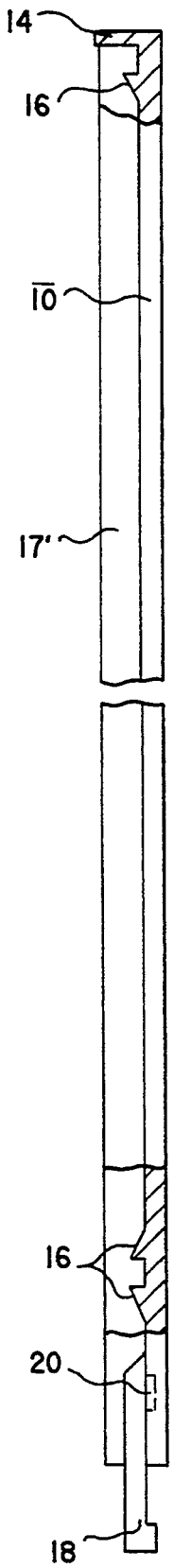
FIG. 4 is a broken side-elevational view of a partial strip for the upper segment of the receiving device.
Figure 5:
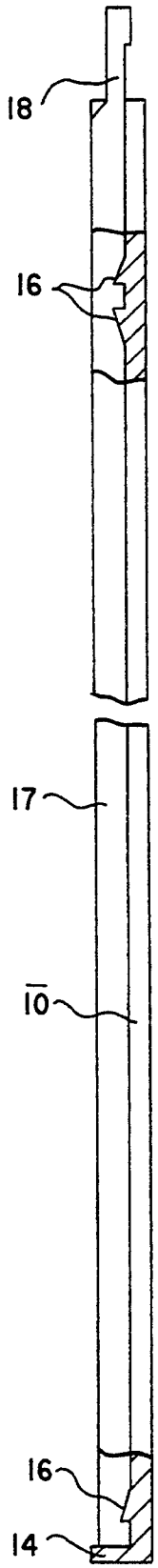
FIG. 5 is a view similar to FIG. 4, but for the lower segment of the receiving device.

As seen in FIG. 2, four longitudinal strips 10 are insertable in the receiver tube 1. The strips are uniformly distributed and attached in the respective vertically aligned openings 4 of the plates 3; 3' and 3''. The longitudinal sides of the strips 10 are conical, so that the strips 10 can be precisely inserted from above or from below in the undercut cutouts 15 of the walls of the openings 4. As seen in FIG. 1, the receiving device has two lateral handles 5.

Figure 6:
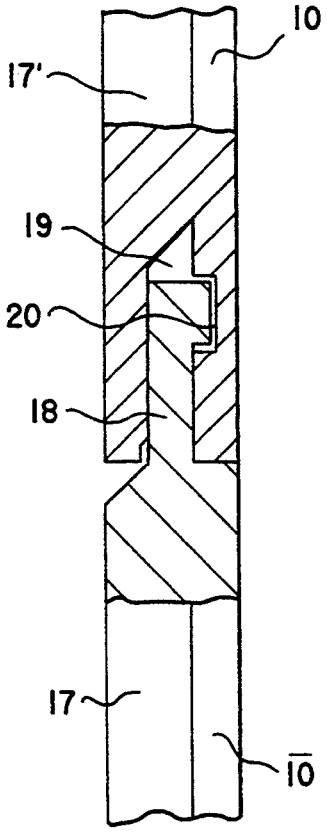
FIG. 6 is a cross-sectional view of the abutment seam of two joined partial strips.
Figure 7:
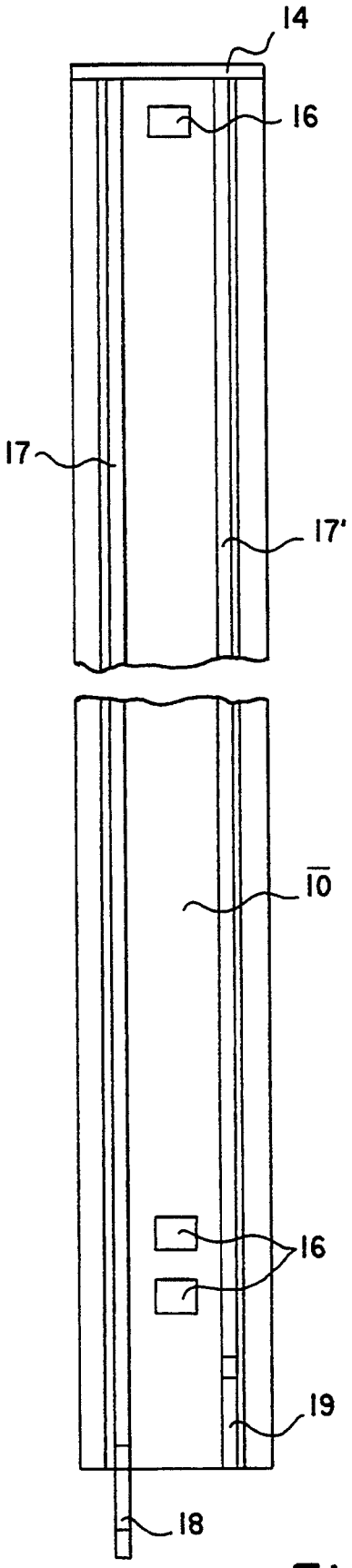
FIG. 7 is a partial side-elevational view of a partial strip according to the invention.

For the purpose of simplifying the manufacture of the receiving device, the longitudinal strips 10 are divided into segments, whereby each segment is separately inserted into the cutouts 15. A connection between the two segments is provided only after the two segments have been inserted. The longitudinal strips 10 include two longitudinally extending ribs 17; 17' on their inside. The rib 17 has a projecting anchoring part 18, which is associated with a corresponding anchoring recess 19 in alignment with the other rib 17'. For connecting the two segments of the longitudinal strip 10, the anchoring part 18 of the rib 17 of one of the strip segments is inserted in the anchoring recess 19 of the rib 17' of the other partial strip. With reference to FIG. 6, in order to enable the insertion and proper attachment of the anchoring part 18 in the anchoring recess 19, the rib 17' is provided with a recess 20 in the region of the anchoring recess 19.

On the end face of the longitudinal strip 10 opposite the anchoring part 18 and the anchoring recess 19, a nose or projection 14 is provided which lies in a rectangular auxiliary recess 15' of the undercut cutout 15 of the upper and of the lower end plates 3; 3'. The auxiliary recess 15' extends only on a part of the plate thickness, so that a remaining jig 15" is retained. The outer limit of the projection 14 lies in a plane with the respectively outer surface of the upper or the lower end plate 3; 3'.

Elastically deformable and conically extending latches 16 are disposed on the inside of the longitudinal strips 10. One latch 16 is provided for each projection 14, which latch conically rises toward the projection 14, whereby the spacing between the projection 14 and the latch 16 corresponds to or is slightly greater that the thickness of the remaining jig of the auxiliary recess 15'.

Two mutually oppositely conical latches 16 of the longitudinal strips 10 are respectively associated with the auxiliary recesses 15'. The spacing between the two latches 16 associated with the intermediate plate 3" corresponds to or is slightly greater than the thickness of the remaining jig 15" of the cutout 15 in the intermediate plate 3".

Referring now to FIGS. 8 and 9, in order to avoid that the stackable containers are inserted in the receiver tubes 1 with the opening facing downward, each receiver tube 1 is provided with at least one elastic element in the form of a leaf spring 21 for reducing the entry diameter of the chute in the region of the upper end plate 3. As seen in FIG. 8, a leaf spring is provided with an upper, angled shorter leg. As seen in FIG. 9, a shiftable element in the form of a slide 22 is shiftable in the region of the clear opening for reducing the diameter of the receiver tube 1. This slide 22 is mounted in a force guide and it is pushed against the force of a spring 23. The end face of the slide 22 may be rounded off or it may be oblique.

Figure 10:
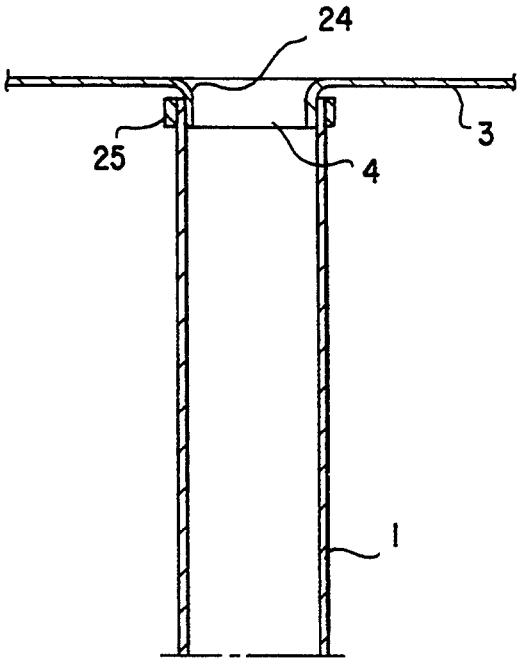
FIG. 10 is a view of a vertical section through the upper attachment of a receiver tube on the end plate.

The edge of the insert opening 4 in the end plate 3 according to FIG. 10 is provided with a downwardly pointing knee 24 in the form of a circumferential flange. A receiver tube 1 is connected to this knee by means of a mount bushing 25. The receiver tube 1 is formed of flexible material.

Figure 11:
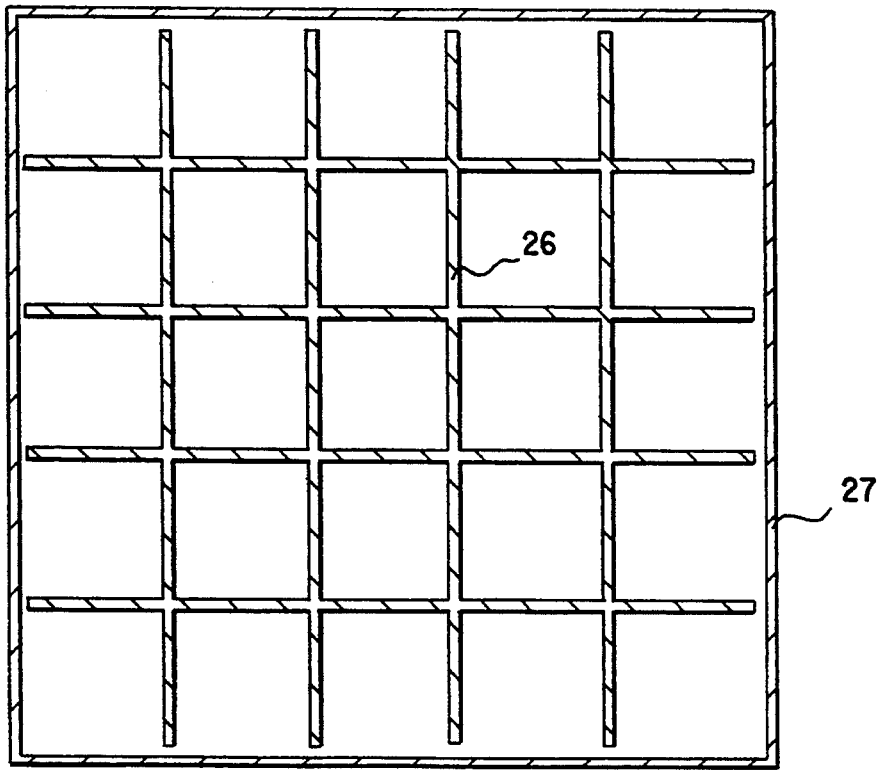
FIG. 11 is a top-plan view of a horizontal section through a honeycomb insert according to the invention inserted in a box.

FIG. 11 shows a honeycomb-shaped insert 26 for a commercially typical box 27 of a base area of 40×40 cm. A minimal spacing is provided between the outer limitation of the inserted honeycomb-shaped insert 26 and the wall of the carton box 27, which facilitates the insertion into the box while not impairing the function of the insert 26.

I claim:

1. Receiving device for stackable containers having a cross-sectional area with a given diameter, comprising an upper end plate having openings formed therein with a diameter being at least slightly larger than the given diameter of the stackable containers, an intermediate plate having openings formed therein and a lower end plate having openings formed therein, a plurality of substantially parallel receiver tubes communicating with respective ones of said openings in said upper end plate and said intermediate plate, said receiver tubes being formed of strips with an arc-shaped cross section extending longitudinally from said upper end plate to said lower end plate and being co-axially and linearly aligned, said openings formed in said upper and lower end plates and in said intermediate plate each including means in the form of undercut cutouts for fastening said strips thereto, said receiver tubes, said intermediate plate, said lower end plate and said upper end plate forming an insert unit for insertion into a garbage container.

2. The receiving device according to claim 1, wherein said longitudinal strips are each formed of two strip segments, each of said segments including latch connector means for connecting said segments to a contiguous unit.

3. The receiving device according to claim 2, wherein each of said longitudinal strips has an end face, said end face including a nose projecting substantially perpendicularly away from said longitudinal strip, and said upper end plate having an auxiliary recess formed therein directly adjacent said opening for receiving said nose of said longitudinal strip such that said end face with said nose is disposed flush with an upper surface of said upper end plate.

4. The receiving device according to claim 1, wherein said intermediate plate has auxiliary recesses formed therein directly adjacent said undercut cutouts, and said longitudinal strips include two oppositely conical latches for clamping therebetween said additional recesses.

5. The receiving device according to claim 1, wherein each of said longitudinal strips has two longitudinal ribs formed thereon.

6. The receiving device according to claim 1, wherein said openings in said upper end plate and an upper segment of said receiver tubes together define an insertion opening for stackable containers and an insertion diameter, and including means disposed in said insertion opening for reducing said insertion diameter of said insertion openings.

7. The receiving device according to claim 6, wherein said reducing means are in the form of an elastic element disposed in said receiver tube in the vicinity of said upper end plate.

8. The receiving device according to claim 7, wherein said elastic element is a leaf spring.

9. The receiving device according to claim 6, wherein said reducing means are in the form of a slidable element, said slidable element being disposed in said receiver tube in the vicinity of said upper end plate and being slidable between a diameter-reducing position and a retracted position.

10. The receiving device according to claim 1, including downwardly pointing knees formed on a circumference of said openings in said upper end plate, said receiver tubes being attached to said knees.

11. The receiving device according to claim 1, wherein each of said longitudinal strips has an end face, said end face including a nose projecting substantially perpendicularly away from said longitudinal strip, and said lower end plate having an auxiliary recess formed therein directly adjacent said opening for receiving said nose of said longitudinal strip such that said end face with said nose is disposed flush with a lower surface of said lower end plate.

12. Receiving device for stackable containers having a cross-sectional area with a given diameter, comprising an upper end plate having openings formed therein with a diameter being at least slightly larger than the given diameter of the stackable containers, an intermediate plate disposed in spaced relationship with said upper end plate, a lower end plate disposed in spaced relationship with said intermediate plate, a plurality of substantially parallel receiver tubes communicating with respective ones of said openings in said upper end plate and being rigidly attached to said upper and lower end plate and said intermediate plate, each of said receiver tubes being formed of an upper tube segment and a lower tube segment being co-axially and linearly aligned with said upper tube segment; said upper and lower end plates, said intermediate plate and said receiver tubes forming an insert unit for insertion into a garbage container.

13. The receiving device according to claim 12, wherein said intermediate plate has openings formed therein for receiving said receiver tubes, said receiver tubes being formed of longitudinally extending strips having an arc-shaped cross section.

* * * * *